US007724219B2

(12) United States Patent
Ikeda

(10) Patent No.: US 7,724,219 B2
(45) Date of Patent: May 25, 2010

(54) CIRCUIT AND METHOD OF EFFECTIVELY ENHANCING DRIVE CONTROL OF LIGHT-EMITTING DIODES

(75) Inventor: Junichi Ikeda, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 1002 days.

(21) Appl. No.: 11/431,647

(22) Filed: May 11, 2006

(65) Prior Publication Data

US 2006/0256050 A1 Nov. 16, 2006

(30) Foreign Application Priority Data

May 11, 2005 (JP) ..... 2005-138788

(51) Int. Cl.
*G09G 3/32* (2006.01)

(52) U.S. Cl. ..... 345/82; 345/102

(58) Field of Classification Search ..... 345/82, 345/102; 315/129

See application file for complete search history.

(56) References Cited

U.S. PATENT DOCUMENTS 5,291,208 A * 3/1994 Young ..... 342/198
5,590,652 A * 1/1997 Inai ..... 600/323
6,817,123 B2 * 11/2004 Okazaki et al. ..... 40/452
2003/0117088 A1 * 6/2003 Tanabe et al. ..... 315/291
2003/0169226 A1 * 9/2003 Yamada ..... 345/102
2005/0140611 A1 * 6/2005 Shih et al. ..... 345/82
2008/0278098 A1 * 11/2008 Kamatani ..... 315/294

FOREIGN PATENT DOCUMENTS

JP 2001-326703 A 11/2001
JP 2004-166342 A 6/2004

* cited by examiner

*Primary Examiner*—Amare Mengistu
*Assistant Examiner*—Premal Patel
(74) *Attorney, Agent, or Firm*—Dickstein Shapiro LLP

(57) ABSTRACT

An LED drive circuit includes a plurality of LEDs, a power supply circuit for outputting a variable output voltage to supply electricity to the LEDs, a plurality of drive transistors for driving the respective LEDs, a bias voltage setting circuit for generating and outputting a reference gate voltage for causing the drive transistors to have drain currents having a predetermined constant value, and a minimum drain voltage for causing the drive transistors to have the predetermined constant drain currents when the reference gate voltage is input to the drive transistors, and a voltage detection circuit for sequentially comparing drain voltages of the drive transistors with the minimum drain voltage to output one of the drain voltages smaller than the minimum drain voltage, wherein the power supply circuit controls the output voltage so that the drain voltage output from the voltage detection circuit becomes greater than or equal to the minimum drain voltage.

4 Claims, 4 Drawing Sheets

CIRCUIT AND METHOD OF EFFECTIVELY ENHANCING DRIVE CONTROL OF LIGHT-EMITTING DIODES

CLAIM FOR PRIORITY

This patent specification is based on Japanese Patent Application No. JP2005-138788 filed on May 11, 2005 in the Japan Patent Office, the entire contents of which are incorporated by reference herein.

FIELD OF THE INVENTION

The present invention relates to a circuit and method of light-emitting diode drive control, and more particularly to a circuit and method of effectively enhancing a drive control of light-emitting diodes.

BACKGROUND OF THE INVENTION

A plurality of white light-emitting diodes are used for a backlight of a liquid crystal display apparatus included in a mobile electronic apparatus such as a cellular phone. A conventional method using a constant-current drive is generally used to cause the plurality of white light-emitting diodes to emit light with even luminance.

FIG. 1 illustrates a light-emitting diode (hereinafter referred to as an LED) drive circuit using the conventional constant-current drive method. As shown in FIG. 1, the LED drive circuit includes an LED LED101 and a resistor R101 having a resistance value r101. When iL (not shown) and Vc represent a drive current and a reference voltage of the LED LED101, respectively, iL is equal to Vc divided by r101 (i.e., iL=Vc/r101).

In the LED drive circuit, the drive current iL of the LED LED101 is controlled so that a voltage drop by the resistor R101 becomes equal to the reference voltage Vc. Therefore, a battery voltage Vbat needs to be larger than a forward voltage VF of the LED LED101 added to the reference voltage Vc. Further, by taking into account the fact that the battery voltage Vbat decreases in the course of use, the battery voltage Vbat needs to be much larger than the forward voltage VF of the LED LED101 added to the reference voltage Vc. As a result, the amount of electricity consumed by components other than the LED LED101 increases, thereby impairing efficiency in power supply.

FIG. 2 illustrates another conventional LED drive circuit. As shown in FIG. 2, the LED drive circuit includes an LED LED111, a resistor R11, a charge pump circuit 111, an LED inactive state detection circuit 112, and a switching control circuit 113.

The charge pump circuit 111 is used as a power source for the LED LED111 so as to attempt to eliminate an influence of fluctuations in the battery voltage Vbat on the LED LED111. The switching control circuit 113 controls switching of the LED LED111 between an active state and an inactive state. The LED inactive state detection circuit 112 detects a state of the LED LED111. When the inactive state of the LED LED111 is detected, an enable signal is turned off to stop operation of the charge pump circuit 111 to attempt to improve efficiency in power supply.

BRIEF SUMMARY OF THE INVENTION

The invention provides a light-emitting diode drive circuit which includes a plurality of light-emitting diodes, a power supply circuit configured to output a variable output voltage to supply electric power to each of the plurality of light-emitting diodes, a plurality of current sources each configured to drive a corresponding one of the plurality of light-emitting diodes, a bias voltage setting circuit configured to generate and output a reference voltage for causing each of the plurality of current sources to have a current having a predetermined constant value, and a minimum set voltage for causing each of the plurality of current sources to have the current having the predetermined constant value when the reference voltage is input to each of the current sources, and a voltage detection circuit configured to sequentially compare output voltages of the plurality of current sources with the minimum set voltage to supply one of the output voltages which is smaller than the minimum set voltage, wherein the power supply circuit is configured to control a supply voltage so that the output voltage output from the voltage detection circuit becomes greater than or equal to the minimum set voltage output from the bias voltage setting circuit.

The invention further provides a method of controlling a circuit for driving a plurality of light-emitting diodes which includes the steps of outputting a variable output voltage to supply electric power to each of the plurality of light-emitting diodes, driving the plurality of light-emitting diodes by using a plurality of current sources, generating a reference voltage for causing each of the plurality of current sources to have a current having a predetermined constant value, outputting the reference voltage, generating a minimum set voltage for causing each of the plurality of current sources to have the current having the predetermined constant value when the reference voltage is input to each of the current sources, outputting the minimum set voltage, sequentially comparing output voltages of the plurality of current sources with the minimum set voltage, outputting one of the output voltages which is smaller than the minimum set voltage, and controlling the output voltage so that the output voltages of all current sources become greater than or equal to the minimum set voltage.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
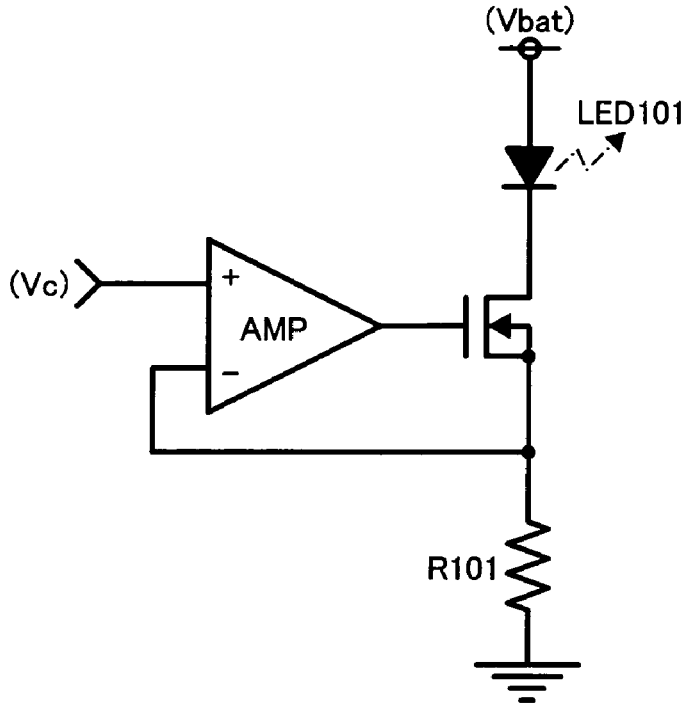
FIG. 1 (PRIOR ART)
FIG. 1 is a circuit diagram illustrating an LED drive circuit using a conventional constant-current drive method.
Figure 2:
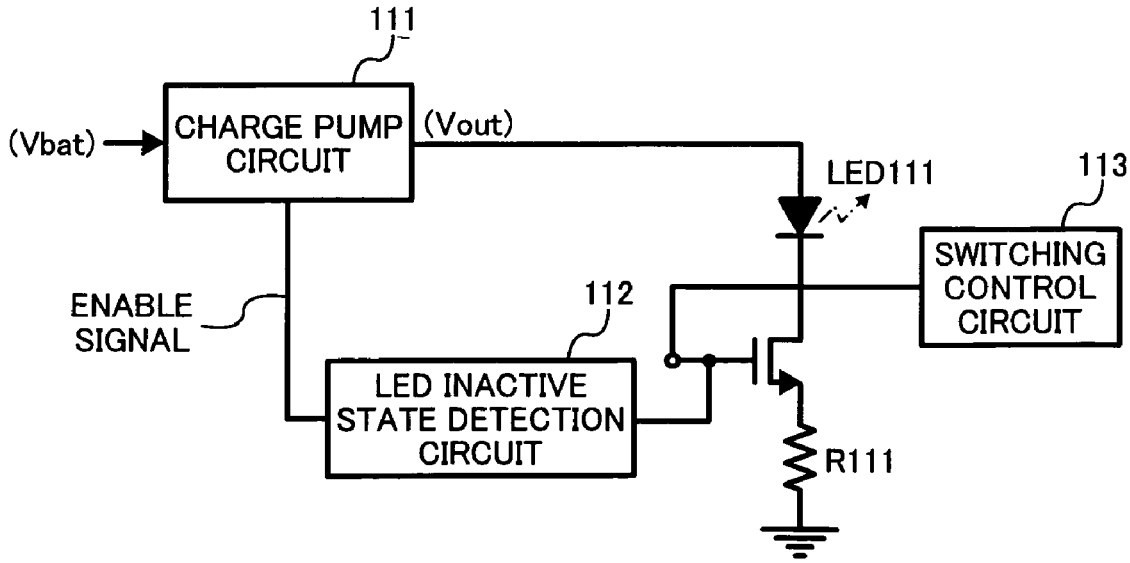
FIG. 2 (PRIOR ART)
FIG. 2 is a circuit diagram illustrating another LED drive circuit using the conventional constant-current drive method.

In describing the preferred embodiment illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 3, an LED drive circuit according to a preferred embodiment of the present invention is described.

Figure 3:
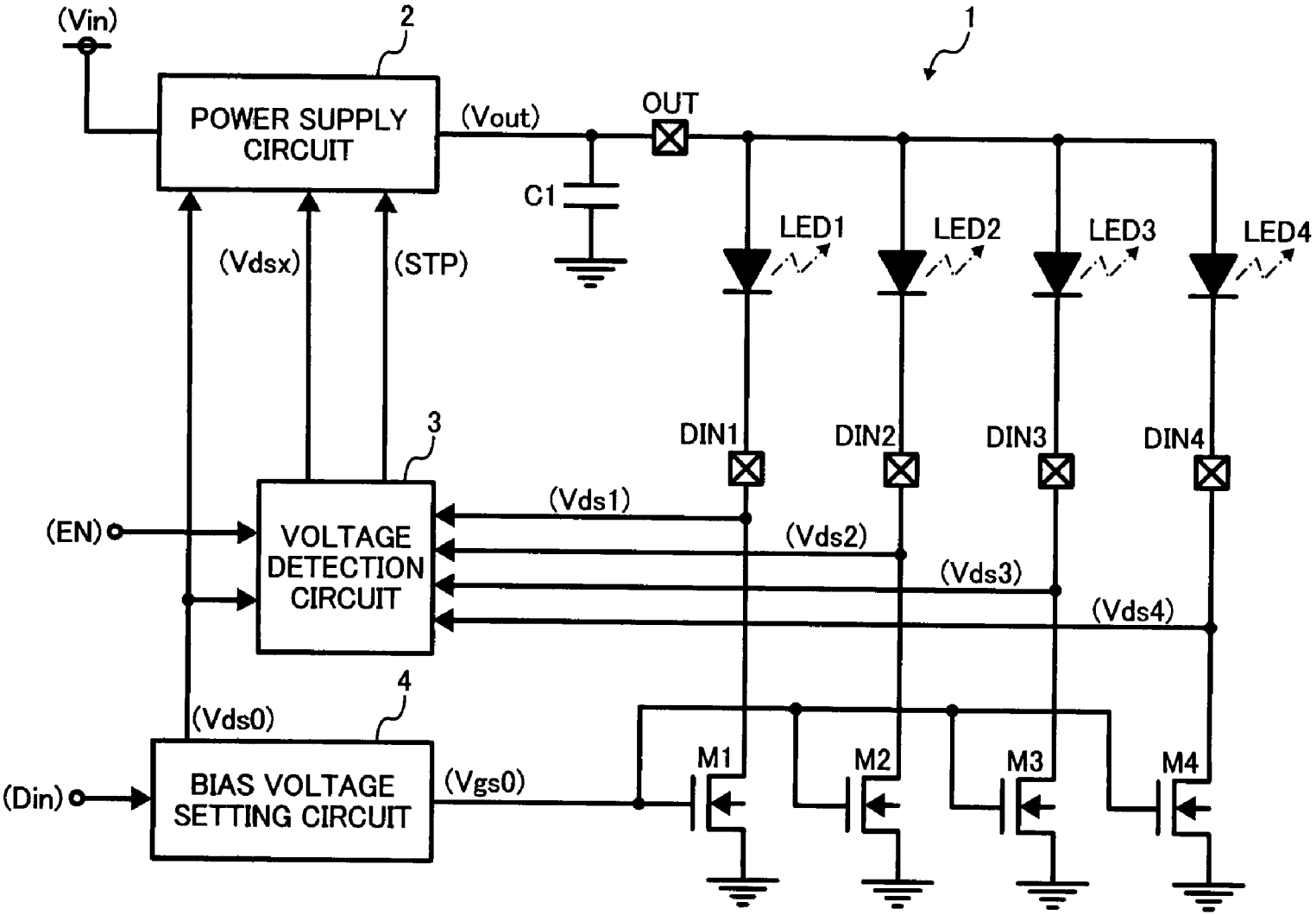
FIG. 3 is a circuit diagram illustrating an LED drive circuit according to an exemplary embodiment of the present invention.

FIG. 3 illustrates an exemplary configuration of an LED drive circuit 1 according to the preferred embodiment of the invention.

As shown in FIG. 3, the LED drive circuit 1 includes a power supply circuit 2; a voltage detection circuit 3; a bias voltage setting circuit 4; LEDs LED1, LED2, LED3, and LED4; drive transistors M1, M2, M3, and M4, each including an NMOS transistor; and a bypass condenser C1. The LED drive circuit 1 further includes an output terminal OUT; and input terminals DIN1, DIN2, DIN3, and DIN4.

The configuration of the LED drive circuit 1 is now described in detail below.

The power supply circuit 2 includes a highly efficient step-up switching regulator including a circuit such as a charge pump circuit. An output terminal of the power supply circuit 2 is connected to ground through the bypass condenser C1.

Further, the power supply circuit 2 is connected to each anode of the LEDs LED1 to LED4 through the output terminal OUT. Cathodes of the LEDs LED1 to LED4 are connected to the voltage detection circuit 3, and to drains of the drive transistors M1 to M4, respectively, through the input terminals DIN1 to DIN4, respectively. Sources of the drive transistors M1 to M4 are connected to respective ground voltages. Gates of the drive transistors M1 to M4 are connected to the bias voltage setting circuit 4.

The power supply circuit 2, the voltage detection circuit 3, and the bias voltage setting circuit 4 are connected to each other.

Next, functions of each component of the LED drive circuit 1 are now described.

The power supply circuit 2 receives an input voltage Vin, and raises the input voltage Vin to a predetermined voltage, and outputs the predetermined voltage as an output voltage Vout. The power supply circuit 2 supplies the output voltage Vout to the LEDs LED1 to LED4. Further, the power supply circuit 2 receives an operation stop signal STP and an output drain voltage Vdsx from the voltage detection circuit 3, and receives a minimum drain voltage Vds0 from the bias voltage setting circuit 4. The power supply circuit 2 stops a switching operation when the operation stop signal STP from the voltage detection circuit 3 becomes active. The power supply circuit 2 causes the output voltage Vout to rise until the output drain voltage Vdsx becomes greater than or equal to the minimum drain voltage Vds0.

In a case in which the power supply circuit 2 includes a charge pump circuit including a catch condenser, the bypass condenser C1 may be removed as the catch condenser has the same function as the bypass condenser C1.

The bias voltage setting circuit 4 receives an external data signal Din including data Din0 to Din3 for setting drive currents for driving the LEDs LED1 to LED4. The bias voltage setting circuit 4 generates a reference gate voltage Vgs0 and the minimum drain voltage Vds0 each having a value according to the data signal Din, and outputs the reference gate voltage Vgs0 and the minimum drain voltage Vds0. The reference gate voltage Vgs0 is input to each of the gates of the drive transistors M1 to M4. When being in a saturation state, the drive transistors M1 to M4 provide respective drain currents. The reference gate voltage Vgs0 sets the drain currents of the drive transistors M1 to M4 to a predetermined constant value of the drive currents for driving the LEDs LED1 to LED4. The minimum drain voltage Vds0 is input to the power supply circuit 2 and the voltage detection circuit 3. The minimum drain voltage Vds0 has a minimum voltage value for causing the drive transistors M1 to M4 to provide the drain currents having the predetermined constant value when the reference gate voltage Vgs0 is input to the drive transistors M1 to M4.

When Vth represents each threshold voltage of the drive transistors M1 to M4, for example, the reference gate voltage Vgs0 and the minimum drain voltage Vds0 generated and output by the bias voltage setting circuit 4 satisfy the following relational expression:

$$Vds0 \geqq Vgs0 - Vth \quad \text{(Expression 1)}$$

The voltage detection circuit 3 receives drain voltages Vds1, Vds2, Vds3, and Vds4 from the drive transistors M1 to M4, respectively, and receives the minimum drain voltage Vds0 from the bias voltage setting circuit 4. The voltage detection circuit 3 sequentially selects one of the drain voltages Vds1 to Vds4 in a predetermined order. When the selected one of the drain voltages Vds1 to Vds4 is smaller than the minimum drain voltage Vds0, the voltage detection circuit 3 exclusively outputs the selected one of the drain voltages Vds1 to Vds4 as the output drain voltage Vdsx to the power supply circuit 2. When the drain voltages Vds1 to Vds4 all become greater than or equal to the minimum drain voltage Vds0, the voltage detection circuit 3 asserts the predetermined operation stop signal STP, in other words, outputs the operation stop signal STP to the power supply circuit 2 to cause the power supply circuit 2 to stop operating.

Further, the voltage detection circuit 3 receives an external enable signal EN. The voltage detection circuit 3 outputs the output drain voltage Vdsx when the enable signal EN is asserted, and stops outputting the output drain voltage Vdsx when the enable signal EN is turned off.

Having the above configuration, the drive transistors M1 to M4 with the gates biased by the reference gate voltage Vgs0 from the bias voltage setting circuit 4 attempt to provide the drain currents having the predetermined constant value from the power supply circuit 2 through the LEDs LED1 to LED4. However, when the output voltage Vout of the power supply circuit 2 is smaller than forward voltages of the LEDs LED1 to LED4, the drain currents of the drive transistors M1 to M4 have smaller values than the predetermined constant value of the drive currents. Accordingly, the drain voltages Vds1 to Vds4 of the drive transistors M1 to M4 are smaller than the minimum drain voltage Vds0.

The voltage detection circuit 3 compares each of the voltages Vds1 to Vds4 of the drive transistors M1 to M4 with the minimum drain voltage Vds0. A method of comparing the voltages is such that, for example, the drain voltage Vds1 of the drive transistor M1 is firstly compared with the minimum drain voltage Vds0, and when the drain voltage Vds1 is smaller than the minimum drain voltage Vds0, the drain voltage Vds1 is output by the voltage detection circuit 3 as the output drain voltage Vdsx. The voltage detection circuit 3 is configured not to output, in this case, results of the comparison between each of the drain voltages Vds2 to Vds4 with the minimum drain voltage Vds0.

The power supply circuit 2 raises the output voltage Vout when the output drain voltage Vdsx output from the voltage detection circuit 3 is smaller than the minimum drain voltage Vds0 output from the bias voltage setting circuit 4. Therefore, the drive currents of the LEDs LED1 to LED4 increase, and the drain voltages Vds1 to Vds4 also increase.

On the other hand, when the output drain voltage Vdsx output from the voltage detection circuit 3 becomes greater than or equal to the minimum drain voltage Vds0, the voltage detection circuit 3 inhibits outputting the drain voltage Vds1 as the output drain voltage Vdsx, as the drain current of the drive transistor M1 reaches the predetermined constant value of the drive currents, and compares the drain voltage Vds2 of the drive transistor M2 with the minimum drain voltage Vds0.

When the forward voltage of the LED LED2 is larger than the forward voltage of the LED LED1, the drain voltage Vds2 of the drive transistor M2 is smaller than the minimum drain voltage Vds0 since the drain voltage Vds2 is smaller than the drain voltage Vds1 of the drive transistor M1. Therefore, the voltage detection circuit 3 outputs the drain voltage Vds2 as the output drain voltage Vdsx. The voltage detection circuit 3 is configured not to output, also in this case, the results of comparison between each of the drain voltages Vds3 and Vds4 with the minimum drain voltage Vds0.

The power supply circuit 2 operates as in the case the drain voltage Vds1 is output as the output drain voltage Vdsx. In other words, the power supply circuit 2 further raises the output voltage Vout until the drain voltage Vds2 becomes greater than or equal to the minimum drain voltage Vds0.

When the drain voltage Vds2 becomes not smaller the minimum drain voltage Vds0, since the drain current of the drive transistor M2 reaches the predetermined constant value of the drive currents, the voltage detection circuit 3 inhibits outputting the drain voltage Vds2 as the output drain voltage Vdsx. Accordingly, the voltage detection circuit 3 sequentially compares the drain voltages Vds3 and Vds4 with the minimum drain voltage Vds0, and raises the output voltage Vout until the drain voltages Vds1 to Vds4 all become greater than or equal to the minimum drain voltage Vds0.

In a case of a drive transistor using an LED having a small forward voltage as a load, a drain voltage of the drive transistor may already be greater than or equal to the minimum drain voltage Vds0 at the time of comparison. In the case, the voltage detection circuit 3 performs comparison between a drain voltage of another transistor and the minimum drain voltage Vds0 without outputting the drain voltage of the drive transistor.

When the drain voltages Vds1 to Vds4 all become greater than or equal to the minimum drain voltage Vds0, the voltage detection circuit 3 asserts the operation stop signal STP to cause the power supply circuit 2 to stop operating. The power supply circuit 2 is provided with the bypass condenser C1 at the output terminal thereof, and a current is supplied to the LEDs LED1 to LED4 from the bypass condenser C1 for a while after the power supply circuit 2 stops operating. When a voltage of the bypass condenser C1 drops, and any one of the drain voltages Vds1 to Vds4 falls below the minimum drain voltage Vds0, the voltage detection circuit 3 turns off the operation stop signal STP, outputs the drain voltage which has fallen below the minimum drain voltage Vds0 as the output drain voltage Vdsx, and causes the power supply circuit 2 to raise the output voltage Vout. As the above operations are repeated, the LEDs LED1 to LED4 are always supplied with the drive currents having the predetermined constant value.

Figure 4:
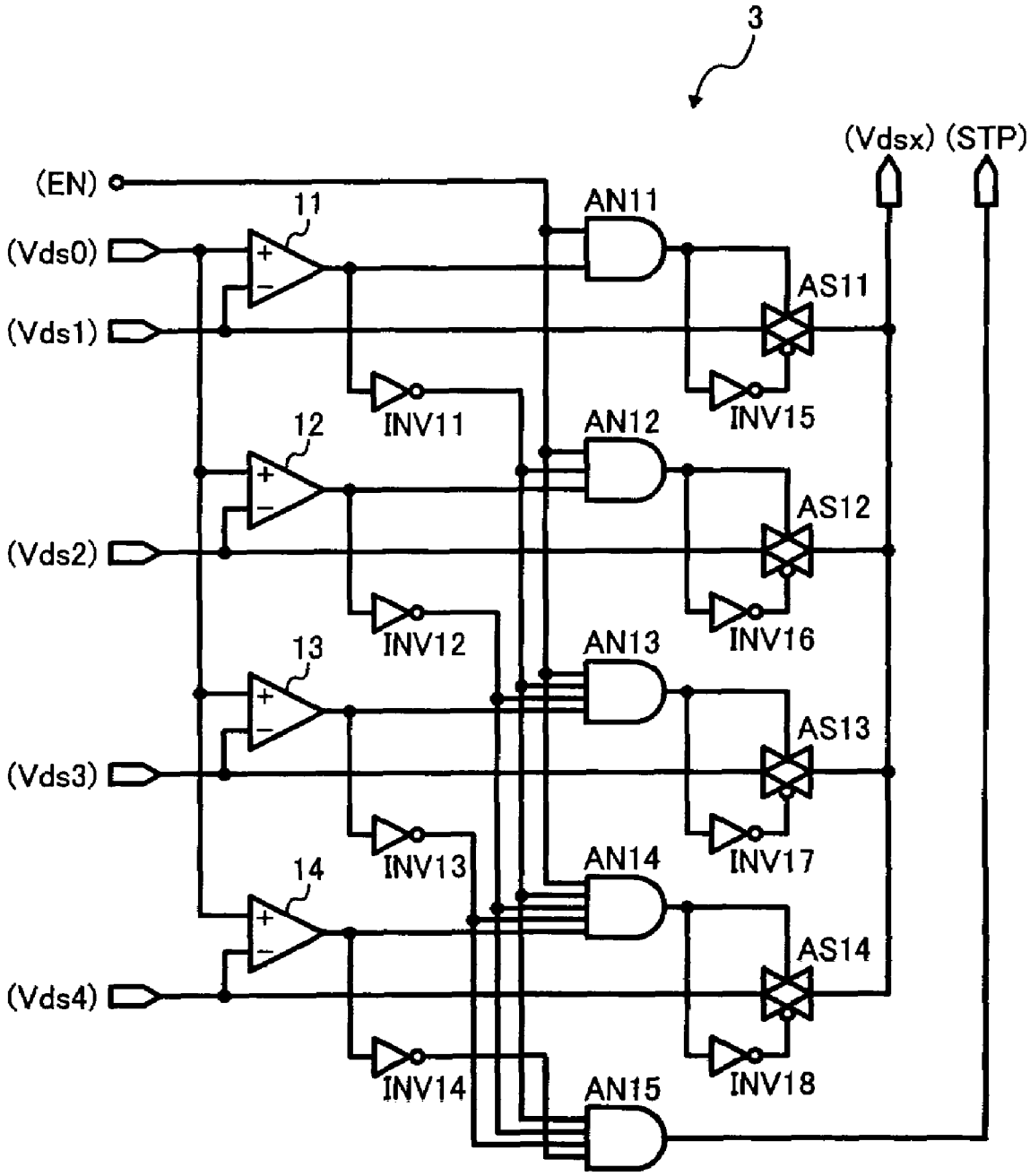
FIG. 4 is a circuit diagram illustrating a voltage detection circuit included in the LED drive circuit shown in FIG. 3.

FIG. 4 illustrates an example of the voltage detection circuit 3 shown in FIG. 3. As shown in FIG. 4, the voltage detection circuit 3 includes comparators 11, 12, 13, and 14; a drain voltage output circuit; and an operation stop signal output circuit. The drain voltage output circuit includes inverters INV11, INV12, INV13, INV14, INV15, INV16, INV17, and INV18; AND circuits AN11, AN12, AN13, and AN14; and analog switches AS11, AS12, AS13, and AS14. The operation stop signal output circuit includes an AND circuit AN15.

A configuration of the voltage detection circuit 3 is described below in detail.

Respective inverting inputs of the comparators 11 to 14 receive the drain voltages Vds1 to Vds4 of the drive transistors M1 to M4, respectively. Non-inverting inputs of the comparators 11 to 14 are connected to each other, and a connection part thereof receives the minimum drain voltage Vds0 from the bias voltage setting circuit 4. Output terminals of the comparators 11 to 14 are connected to input terminals of the AND circuits AN11 to AN14, respectively, and to input terminals of the inverter INV 11 to 14, respectively.

The AND circuit AN11 paired with the comparator 11 includes two input terminals. The AND circuit AN12 paired with the comparator 12 includes three input terminals. The AND circuit AN13 paired with the comparator 13 includes four input terminals. The AND circuit AN14 paired with the comparator 14 includes five input terminals. The AND circuit AN15 includes four input terminals. Output terminals of the AND circuits AN11 to AN14 are connected to control input terminals of the analog switches AS11 to AS14, respectively, and to inverting control input terminals of the analog switches AS11 to AS14, respectively, through inverters INV15 to INV18, respectively.

An output terminal of the inverter INV11 is connected to the input terminals of the AND circuits AN12 to AN15. An output terminal of the inverter INV12 is connected to the input terminals of the AND circuits AN13 to AN15. An output terminal of the inverter INV13 is connected to the input terminals of the AND circuits AN14 and AN15. An output terminal of the inverter INV14 is connected to the input terminal of the AND circuit AN15. An output terminal of the AND circuit AN15 serves as an output terminal for outputting the operation stop signal STP. Further, each of the remaining input terminals of the AND circuits AN11 to AN14 receive the enable signal EN from outside. Input terminals of the analog switches AS11 to AS14 receive the drain voltages Vds1 to Vds4 of the drive transistors M1 to M4, respectively. Output terminals of the analog switches AS11 to AS14 are connected to each other, and a connection part thereof serves as an output terminal of the voltage detection circuit 3 for outputting the output drain voltage Vdsx.

Next, operations of each component of the voltage detection circuit 3 are described below.

When a signal level of the enable signal EN is low, output levels of the AND circuits AN11 to AN14 are low. In the case, the analog switches AS11 to AS14 are turned off and shut off. As a result, the output terminal for outputting the output drain voltage Vdsx has high impedance.

On the other hand, when the signal level of the enable signal EN is high, the following operations are performed. The comparator 11 compares the minimum drain voltage Vds0 with the drain voltage Vds1 of the drive transistor M1. When the drain voltage Vds1 is smaller than the minimum drain voltage Vds0, an output level of the comparator 11 becomes high to cause an output level of the AND circuit 11 to be high. As a result the analog switch AS11 is turned on, and the drain voltage Vds1 input to the input terminal of the analog switch AS11 is output as the output drain voltage Vdsx. Since an output signal of the comparator 11 is input to the input terminals of the AND circuits AN12 to AN15 with a signal level inverted in the inverter INV11, output levels of the AND circuits AN12 to AN15 become low. As a result, the analog switches AS12 to AS14 are turned off and shut off. Therefore, only the drain voltage Vds1 is output from the output terminal as the output drain voltage Vdsx. Further, a signal level of the operation stop signal STP becomes low to negate the operation stop signal STP.

As described above, the output voltage Vout of the power supply circuit 2 is raised. When the output voltage Vout of the power supply circuit 2 increases, and the drain voltage Vds1 becomes greater than or equal to the minimum drain voltage Vds0, the output level of the comparator 11 becomes low, and the output level of the AND circuit AN11 also becomes low. As a result, the analog switch AS11 is turned off to stop outputting the drain voltage Vds1 as the output drain voltage Vdsx. Further, as the output level of the comparator 11 becomes low, the output level of the inverter INV11 becomes high. As a result, a gate of the AND circuit AN12 is opened.

Then, the comparator 12 compares the minimum drain voltage Vds0 with the drain voltage Vds2 of the drive transistor M2. When the drain voltage Vds2 is smaller than the minimum drain voltage Vds0, an output level of the comparator 12 becomes high, and the output level of the AND circuit AN12 also becomes high. As a result, the analog switch AS12 is turned on, and the drain voltage Vds2 input to the input terminal of the analog switch AS12 is output as the output drain voltage Vdsx. Since an output signal of the comparator 12 is input to the input terminals of the AND circuits AN13 to AN15 with a signal level inverted in the inverter INV12, the output levels of the AND circuits AN13 to AN15 become low. As a result, the analog switches AS13 and AS14 are turned off and shut off. Therefore, only the drain voltage Vds2 is output as the output drain voltage Vdsx.

Next, the output voltage Vout of the power supply circuit 2 is raised. When the output voltage Vout of the power supply circuit 2 increases, and the drain voltage Vds2 becomes greater than or equal to the minimum drain voltage Vds0, the output level of the comparator 12 is inverted to low, and the output level of the AND circuit AN12 also becomes low. As a result, the analog switch AS12 is turned off to stop outputting the drain voltage Vds2 as the output drain voltage Vdsx.

Subsequent operations are performed by repeating procedures as described above, and when the drain voltages Vds1 to Vds4 all become greater than or equal to the minimum drain voltage Vds0, no drain voltage is output as the output drain voltage Vdsx. Instead, the output level of the AND circuit AN15 becomes high to assert the operation stop signal STP. When the operation stop signal STP is input to the power supply circuit 2, the power supply circuit 2 stops operating, and as a result, stops supplying power.

Figure 5:
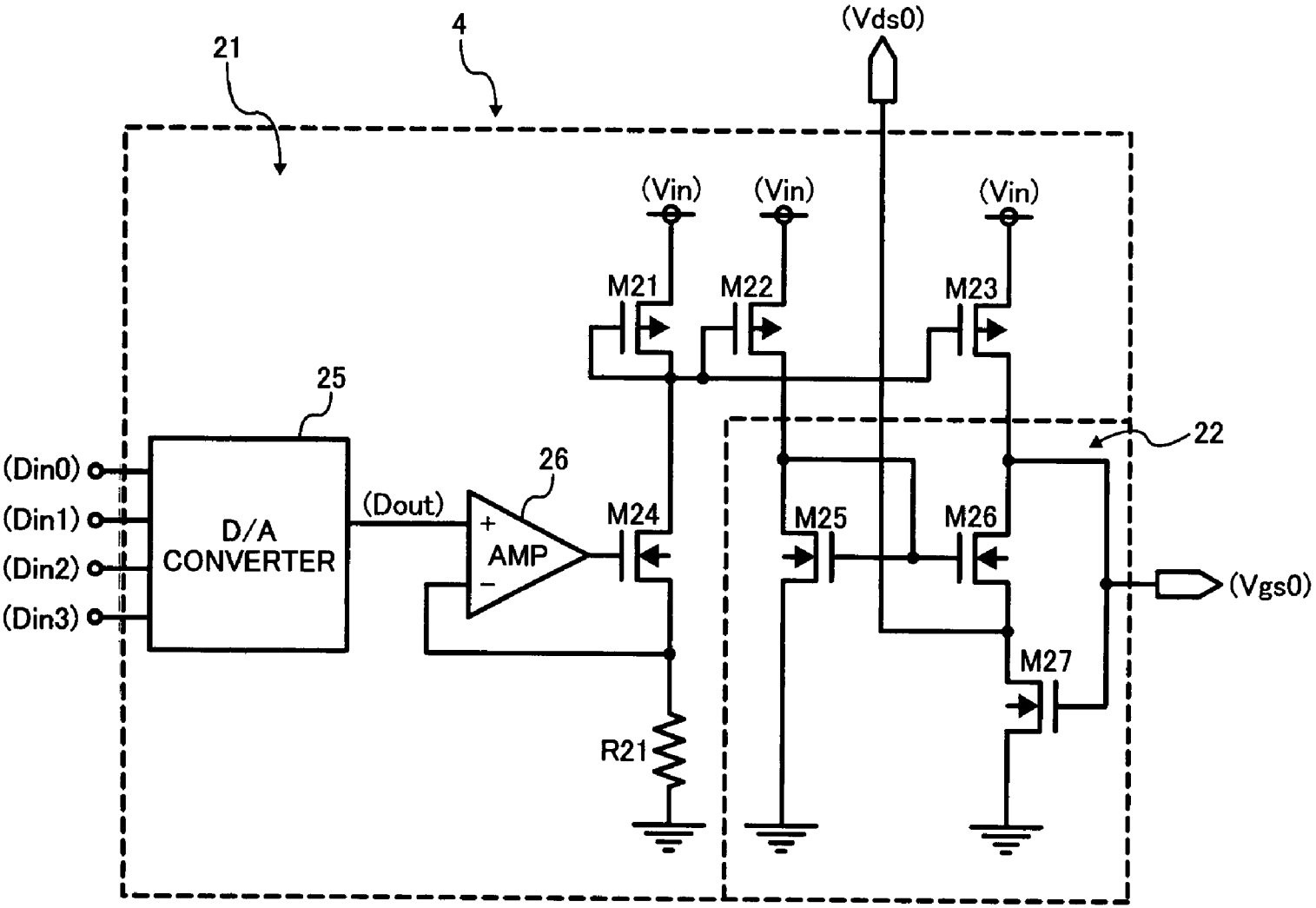
FIG. 5 is a circuit diagram illustrating a bias voltage setting circuit included in the LED drive circuit shown in FIG. 3.

FIG. 5 illustrates an example of the bias voltage setting circuit 4 shown in FIG. 3. As shown in FIG. 5, the bias voltage setting circuit 4 includes a proportional current generation circuit 21 serving as a constant-current circuit, and a voltage generation circuit 22.

The proportional current generation circuit 21 includes a D/A converter 25; an operation amplification circuit 26; a current mirror circuit including PMOS transistors M21, M22, and M23; an NMOS transistor M24; and a resistor R21. The voltage generation circuit 22 includes NMOS transistors M25, M26, and M27 serving as first, second, and third MOS transistors, respectively.

The proportional current generation circuit 21 generates currents proportional to the drive currents of the LEDs LED1 to LED4. The voltage generation circuit 22 generates the reference gate voltage Vgs0 and the minimum drain voltage Vds0.

A configuration of the bias voltage setting circuit 4 is described in detail below.

An output terminal of the D/A converter is connected to a non-inverting input terminal of the operation amplification circuit 26. An output terminal of the operation amplification circuit 26 is connected to a gate of the NMOS transistor M24. An inverting input terminal of the operation amplification circuit 26 is connected to a source of the NMOS transistor M24, and is connected to ground through the resistor R21. A drain of the NMOS transistor M24 is connected to a drain of the PMOS transistor M21 which is connected to a gate of the PMOS transistor M21. Further, sources of the PMOS transistors M21 to M23 are connected to respective input voltages Vin, and gates of the PMOS transistors M21 to M23 are connected to each other.

A drain of the PMOS transistor M22 is connected to a drain of the NMOS transistor M25, and a source of the NMOS transistor M25 is connected to ground. A gate of the NMOS transistor M25 is connected to the drain of the NMOS transistor M25, and to a gate of the NMOS transistor M26. A drain of the PMOS transistor M23 is connected to a drain of the NMOS transistor M26, and to a gate of the NMOS transistor M27. A source of the NMOS transistor M26 is connected to a drain of the NMOS transistor M27. A source of the NMOS transistor M27 is connected to ground.

The D/A converter 25 receives the data Din0 to Din3 for setting the drive currents of the LEDs LED1 to LED4 from an external control circuit (not shown). The D/A converter outputs an output voltage Dout to the non-inverting input terminal of the operation amplification circuit 26. The reference gate voltage Vgs0 is output from a connection part between the drain of the NMOS transistor M26 and the gate of the NMOS transistor M27. The minimum drain voltage Vds0 is output from a connection part between the source of the NMOS transistor M26 and the drain of the NMOS transistor M27.

According to the above configuration, a drain current of the NMOS transistor M24 is derived by the output voltage Dout of the D/A converter 25, which is set by the data Din0 to Din3, divided by a resistance value of the resistor R21. The drain current of the NMOS transistor M24 is proportional to the drive currents of the LEDs LED1 to LED, and is output from each of the drains of the PMOS transistors M22 and M23 included in the current mirror circuit. Further, the NMOS transistor M27 forms another current mirror circuit with the drive transistors M1 to M4. A size of an element of the NMOS transistor M27 to a size of each element of the drive transistors M1 to M4 is in a predetermined proportion, and the drain currents of the drive transistors M1 to M4 are determined by a drain current of the NMOS transistor M27 multiplied by a factor of the predetermined proportion. When the predetermined proportion is 1 to 500, for example, each of the drain currents of the drive transistors M1 to M4 is 500 times as large as the drain current of the NMOS transistor M27.

Further, minimum drain voltages of the drive transistors M1 to M4 for maintaining a proportional relation with the drain current of the NMOS transistor M27 is equal to the minimum drain voltage Vds0 which is a drain voltage of the NMOS transistor M27.

Further, the drain voltage of the NMOS transistor M27 is determined by drain currents of the PMOS transistors M22 and M23, and a ratio of a size of the NMOS transistor M25 to a size of the NMOS transistor M26. Therefore, it is possible to set the drain voltage of the NMOS transistor M27 to a minimum voltage for feeding proportional amounts of currents to the drive transistors M1 to M4. Since source and drain voltages of the drive transistors M1 to M4 can be set to small values, an excessive rise in voltage is not necessary, and as a result, electricity saving may be achieved.

When the PMOS transistors M22 and M23 are configured to have the same size and the same drain current, and the ratio of the size of the NMOS transistor M25 to the size of the NMOS transistor M26 is set to 1 to 4, the minimum drain voltage Vds0 is set to a minimum voltage for the NOMS transistor M27 to operate as a constant-current source. However, the present invention is not limited to the above configuration. In consideration of variations in bias effects of substrates, the ratio of the size of the NMOS transistor M25 to the size of the NMOS transistor M26 is not limited to such a value that theoretically sets the minimum drain voltage Vds0, and includes such a value that can secure a constant-current value in each process.

According to the above configuration, the output voltage Vout of the power supply circuit 2 may be equal a largest forward voltage among the forward voltages of the LEDs LED1 to LED4 added with the minimum drain voltage Vds0 of a corresponding one of the drive transistors M1 to M4. Therefore, the minimum drain voltage Vds0 is considerably small compared with the forward voltages of the LEDs LED1 to LED4. As a result, drive efficiency of the LEDs LED1 to LED4 may be significantly enhanced.

As described above, since the LED drive circuit 1 according to the embodiment of the present invention does not use a resistor for setting the drive currents of the LEDs LED1 to LED4, the output voltage Vout of the power supply circuit 2 may be reduced for an amount corresponding to a voltage drop otherwise caused by the resistor. Further, the output voltage Vout of the power supply circuit 2 only needs to supply the predetermined drive current to the LED having the largest forward voltage. As a result, the output voltage Vout may be further reduced.

In addition, since the drive transistors M1 to M4 are configured to have the minimum drain voltage Vds0 for feeding the drive currents having the predetermined constant value in the saturation state, the output voltage Vout of the power supply circuit 2 may be further reduced, thereby significantly enhancing the drive efficiency of the LEDs LED1 to LED4.

Although the above embodiment describes the exemplary case in which four LEDs are driven, the present invention is not limited thereto. The present invention is applied to an LED drive circuit for driving a plurality of LEDs.

The above specific embodiment is illustrative, and many variations can be introduced on the embodiment without departing from the spirit of the disclosure or from the scope of the appended claims. For example, elements and/or features of different illustrative embodiments may be combined with each other and/or substituted for each other within the scope of this disclosure and appended claims.

What is claimed as new and desired to be protected by Letters Patent of the United States is:

1. A light-emitting diode drive circuit, comprising:

a plurality of light-emitting diodes;

a power supply circuit configured to supply a variable voltage to supply electric power to each of the plurality of light-emitting diodes;

a plurality of current sources each configured to drive a corresponding one of the plurality of light-emitting diodes;

a bias voltage setting circuit configured to generate and output a reference voltage for causing each of the plurality of current sources to have a current having a predetermined constant value, and a minimum set voltage for causing each of the plurality of current sources to have the current having the predetermined constant value when the reference voltage is input to each of the current sources; and a voltage detection circuit configured to sequentially compare output voltages of the plurality of current sources with the minimum set voltage to supply one of the output voltages which is smaller than the minimum set voltage, wherein the power supply circuit is configured to control the variable voltage so that the output voltage output from the voltage detection circuit becomes greater than or equal to the minimum set voltage output from the bias voltage setting circuit, wherein the voltage detection circuit outputs a predetermined operation stop signal to the power supply circuit when the output voltages of the plurality of the current sources all become greater than or equal to the minimum set voltage and wherein the voltage detection circuit comprises:

a plurality of comparators each configured to compare a drain voltage of a respective one of the plurality of current sources with the minimum set voltage, wherein each of the plurality of comparators performs the comparison in a predetermined order;

a drain voltage output circuit configured to exclusively output one of the drain voltages of the plurality of current sources which is smaller than the minimum set voltage according to results of the comparison performed by the plurality of comparators, wherein the drain voltage output circuit outputs the drain voltages in the predetermined order; and an operation stop signal output circuit configured to output the predetermined operation stop signal to the power supply circuit to cause the power supply circuit to stop operating when operation stop signal output circuit detects from the results of the comparison performed by the plurality of comparators that the drain voltages of the plurality of current sources are all greater than or equal to the minimum set voltage.

2. The light-emitting diode drive circuit according to claim 1, wherein:

the plurality of current sources comprises a plurality of drive transistors, each of said drive transistors configured to drive a corresponding one of the plurality of light-emitting diodes;

the reference voltage comprises a reference gate voltage for causing each of the plurality of drive transistors to have the current having the predetermined constant value;

the minimum set voltage comprises a minimum drain voltage for causing each of the plurality of drive transistors to have the current having the predetermined constant value when the reference gate voltage is input to each of the drive transistors; and the minimum drain voltage and the reference gate voltage generated by the bias voltage setting circuit satisfy such a relation that the minimum drain voltage is greater than or equal to a threshold voltage of the plurality of the drive transistors subtracted from the reference gate voltage.

3. The light-emitting diode drive circuit according to claim 2, wherein the bias voltage setting circuit comprises:

a constant-current circuit configured to generate and output first and second currents having externally set values; a first MOS transistor having the same type as the plurality of drive transistors, configured to be supplied with the first current, and to include a gate and a drain connected to each other;

a second MOS transistor having the same type as the plurality of drive transistors, configured to have a gate connected to a gate of the first MOS transistor, and a drain supplied with the second current; and a third MOS transistor having the same type as the plurality of drive transistors, configured to have a gate connected to the drain of the second MOS transistor at a connection part, wherein the reference gate voltage is output from the connection part, and the minimum drain voltage is output from another connection part of the second and third MOS transistors.

4. The light-emitting diode drive circuit according to claim 3, wherein the power supply circuit comprises a step-up switching regulator.

* * * * *